US005698384A

United States Patent [19]

Anderson et al.

[11] Patent Number: 5,698,384

[45] Date of Patent: Dec. 16, 1997

[54] IMAGING ELEMENT COMPRISING AN ELECTRICALLY-CONDUCTIVE LAYER WITH ENHANCED ABRASION RESISTANCE

[75] Inventors: Charles Chester Anderson; Yongcai Wang, both of Penfield; James Lee Bello, Rochester; Mario Dennis DeLaura, Hamlin, all of N.Y.

[73] Assignee: Eastman Kodak Company, Rochester, N.Y.

[21] Appl. No.: 567,755

[22] Filed: Dec. 5, 1995

Related U.S. Application Data

[60] Provisional application No. 60/000,236 Jun. 15, 1995.

[51] Int. Cl.[6] ..... G03C 1/76

[52] U.S. Cl. ..... 430/523; 430/527; 430/529; 430/530; 430/537; 430/539; 430/631; 430/639; 430/640; 430/950

[58] Field of Search ..... 430/523, 63, 271.1, 430/527, 529, 530, 537, 539, 631, 640, 639, 950

[56] References Cited

U.S. PATENT DOCUMENTS

| | | | |
|---|---|---|---|
| 4,232,117 | 11/1980 | Naoi et al. | 430/523 |
| 5,340,676 | 8/1994 | Anderson et al. | 430/527 |
| 5,466,567 | 11/1995 | Anderson et al. | 430/527 |

*Primary Examiner*—Geraldine Letscher
*Attorney, Agent, or Firm*—Carl F. Ruoff; Alfred P. Lorenzo

[57] ABSTRACT

Imaging elements, such as photographic, electrostatographic and thermal imaging elements, are comprised of a support, an image-forming layer and an electrically-conductive layer comprising electronically-conductive fine particles, such as antimony-doped tin oxide particles, and gelatin-coated water-insoluble polymer particles. The use of gelatin-coated water-insoluble polymer particles as a binder in the electrically-conductive layer facilitates the preparation of stable coating compositions and provides a layer with a high degree of conductivity at low concentrations of electronically-conductive fine particles and with excellent abrasion resistant properties.

19 Claims, No Drawings

IMAGING ELEMENT COMPRISING AN ELECTRICALLY-CONDUCTIVE LAYER WITH ENHANCED ABRASION RESISTANCE

CROSS REFERENCE TO RELATED APPLICATION

Reference is made to and priority claimed from U.S. Provisional application Ser. No. 60/000,236, filed 15 Jun. 1995, entitled IMAGING ELEMENT COMPRISING AN ELECTRICALLY-CONDUCTIVE LAYER WITH ENHANCED ABRASION RESISTANCE.

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to such imaging elements having an electrically-conductive layer with a high degree of abrasion resistance.

BACKGROUND OF THE INVENTION

A variety of problems associated with the formation and discharge of electrostatic charge during the manufacture and use of photographic films are well recognized in the photographic industry. These electrostatic charges are generated by the highly insulating polymeric film bases such as polyester and cellulose acetate during winding and unwinding operations associated with the photographic film manufacturing process and during the automated transport of photographic films in film cassette loaders, cameras, and film processing equipment during use of the photographic film product.

It is well known that electrostatic charges can be effectively controlled or eliminated by incorporating one or more electrically-conductive antistatic layers in the photographic film. A wide variety of conductive materials can be incorporated into antistatic layers to provide a wide range of conductivity and antistatic performance. Typically, the antistatic layers for photographic applications employ materials which exhibit ionic conductivity where the charge is transferred by the bulk diffusion of charged species through an electrolyte. Antistatic layers comprising inorganic salts, ionic conductive polymers, and colloidal metal oxide sols stabilized by salts have been described. U.S. Pat. No. 4,542,095 discloses antistatic compositions for use in photographic elements wherein aqueous latex compositions are used as binder materials in conjunction with polymerized alkylene oxide monomers and alkali metal salts as the antistatic agents. U.S. Pat. No. 4,916,011 describes antistatic layers comprising ionically conductive styrene sulfonate interpolymers, a latex binder, and a crosslinking agent. U.S. Pat. No. 5,045,394 describes antistatic backing layers containing Al-modified colloidal silica, latex binder polymer, and organic or inorganic salts which provide good writing or printing surfaces. The conductivities of these ionic conductive antistatic layers are very dependent on humidity and film processing. At low humidities and after conventional film processing the antistatic performance is substantially reduced or ineffective.

Antistatic layers employing electronic conductors have also been described. The conductivity of these materials depends on primarily electronic mobilities rather than ionic mobilities and the conductivity is independent of humidity. Antistatic layers which contain conjugated polymers, semiconductive metal halide salts, conductive carbon or semiconductive metal oxide particles have been described. It is characteristic of these electronically conductive materials to be highly colored or have high refractive index. Thus, providing highly transparent, coloress antistatic layers containing these materials poses a considerable challenge.

U.S. Pat. No. 3,245,833 describes conductive coatings containing semiconductive silver or copper iodide dispersed as 0.1 μm or less particles in an insulating film-forming binder exhibiting surface resistivities of $10^2$ to $10^{11}$ Ω/□. However, these coatings must be overcoated with a water-impermeable barrier layer to prevent the loss of conductivity after film processing since these semiconductive salts are solubilized by conventional film processing solutions.

Conductive layers comprising inherently conductive polymers such as polyacetylene, polyaniline, polythiophene, and polypyrrole are described in U.S. Pat. No. 4,237,194, JP A2282245, and JP A2282248, but, these layers are highly colored.

Conductive fine particles of crystalline metal oxides dispersed with a polymeric binder have been used to prepare humidity insensitive, conductive layers for various imaging applications. Many different metal oxides are alleged to be useful as antistatic agents in photographic elements or as conductive agents in electrographic elements in such patents as U.S. Pat. Nos. 4,275,103, 4,394,441, 4,416,963, 4,418,141, 4,431,764, 4,495,276, 4,571,361, 4,999,276, 5,368,995. Preferred metal oxides are antimony doped tin oxide, aluminum doped zinc oxide, niobium doped titanium oxide, and metal antimonates. The high volume % of the conductive fine particles in the conductive coatings as taught in the prior art to achieve effective antistatic performance results in reduced transparency due to scattering losses and in brittle films subject to cracking and poor adherence to the support material.

JP A4055492 describes antistatic layers comprising conductive non-oxide particles including TiN, $NbB_2$, TiC, and MoB dispersed in a binder such as a water soluble polymer or solvent soluble resin.

U.S. Pat. No. 5,066,422 describes vinyl surface covering materials comprising a fused sheet of a dry blend, wherein the dry blend contains a polyvinyl chloride porous resin, a plasticizer, and conductive particles. Reportedly, the conductive particles reside in the pores and surface of the polyvinyl chloride resin which thereby provides surface resistivities of the fused sheet of $10^9$ Ω/□ at low weight % of the conductive particles.

Fibrous conductive powders comprising antimony doped tin oxide coated onto nonconductive potassium titanate whiskers have been used to prepare conductive layers for photographic and electrographic applications. Such materials have been disclosed in U.S. Pat. No. 4,845,369, U.S. Pat. No. 5,116,666, JP A63098656, and JP A63060452. Layers containing these conductive whiskers dispersed in a binder reportedly provide improved conductivity at lower volume % than the aforementioned conductive fine particles as a result of their higher aspect (length to diameter) ratio. However, the benefits obtained as a result of the reduced volume % requirements are offset by the fact that these materials are large in size (10 to 20 μm long and 0.2–0.5 μm diameter). The large size results in increased light scattering and hazy coatings.

Transparent, binderless, electrically semiconductive metal oxide thin films formed by oxidation of thin metal films which have been vapor deposited onto film base are described in U.S. Pat. No. 4,078,935. The resistivity of such conductive thin films has been reported to be $10^5$ Ω/□. However, these metal oxide thin films are unsuitable for photographic film applications since the overall process used to prepare them is complex and expensive and adhesion of these thin films to the film base and overlying layers is poor.

U.S. Pat. No. 4,203,769 describes an antistatic layer incorporating "amorphous" vanadium pentoxide. This vanadium pentoxide antistat is highly entangled, high aspect ratio ribbons 50–100 Angstroms wide, about 10 Angstroms thick, and 0.1–1 μm long. As a result of this ribbon structure surface resistivities of $10^6$–$10^{11}$ Ω/□ can be obtained for coatings containing very low volume fractions of vanadium pentoxide. This results in very low optical absorption and scattering losses, thus the coatings are highly transparent and colorless. However, vanadium pentoxide is soluble at the high pH typical of film developer solutions and must be overcoated with a nonpermeable barrier layer to maintain antistatic performance after film processing.

It can be seen that a variety of methods have been reported in an attempt to obtain non-brittle, adherent, highly transparent, colorless conductive coatings with humidity independent, film process surviving antistatic performance. However, the aforementioned prior art references are deficient with regard to simultaneously satisfying all of the above mentioned requirements.

U.S. Pat. No. 5,340,676 describes conductive layers comprising electrically-conductive fine particles, hydrophilic colloid, and water-insoluble polymer particles. Representative polymer particles described include polymers and interpolymers of styrene, styrene derivatives, alkyl acrylates or alkyl methacrylates and their derivatives, olefins, vinylidene chloride, acrylonitrile, acrylamide and methacrylamide and their derivatives, vinyl esters, vinyl ethers, or condensation polymers such as polyurethanes and polyesters. The use of a mixed binder comprising the polymer particles mentioned above in combination with a hydrophilic colloid such as gelatin provides a conductive coating that requires lower volume % conductive fine particles compared with a layer obtained from a coating composition comprising the conductive fine particles and water soluble hydrophilic colloid alone.

It is toward the objective of providing improved imaging elements having enhanced properties in comparison with the imaging elements of U.S. Pat. No. 5,340,676 that the present invention is directed.

SUMMARY OF THE INVENTION

In accordance with this invention, an imaging element for use in an image-forming process comprises a support, an image-forming layer, and an electrically-conductive layer. The electrically-conductive layer comprises electronically-conductive fine particles and gelatin-coated water-insoluble polymer particles. The combination of electronically-conductive fine particles and gelatin-coated water-insoluble polymer particles provides conductive coatings which can employ low volume percentages of conductive particles and still provide the desired high degree of conductivity. The coatings strongly adhere to underlying and overlying layers such as photographic support materials and hydrophilic colloid layers.

In comparison with U.S. Pat. No. 5,340,676, the binder for the electronically-conductive fine particles comprises gelatin-coated water-insoluble polymer particles rather than a mixture of water-insoluble polymer particles and a hydrophilic colloid such as gelatin. The use of gelatin-coated water-insoluble polymer particles provides much better coating solution stability. Moreover, the electrically-conductive layer has significantly enhanced wet abrasion properties as compared with the electrically-conductive layer of U.S. Pat. No. 5,340,676, while still providing the benefits of reduced volume % of conductive fine particles as described in the '676 patent.

Electrically-conductive layers comprising electronically-conductive fine particles, a film-forming hydrophilic colloid and pre-crosslinked gelatin particles also provide a highly advantageous combination of characteristics. Such layers are described in copending commonly-assigned U.S. patent application Ser. No. 330,409, filed Oct. 28, 1994, "Imaging Element Comprising An Electrically-Conductive Layer Containing Conductive Fine Particles, A Film-Forming Hydrophilic Colloid And Pre-Crosslinked Gelatin Particles" by Charles C. Anderson, Yoncai Wang, James L. Bello, Ibrahim M. Shalhoub and Douglas D. Corbin. The combination of hydrophilic colloid and pre-crosslinked gelatin particles as a binder for the electronically-conductive fine particles provides the benefit of reduced volume % of conductive fine particles and good coating solution stability. The gelatin-coated water-insoluble polymer particles employed as the binder in the present invention provide similar benefits to the pre-crosslinked gelatin particles but the particles in the present invention are more easily prepared and dispersed and their size and size distribution are more readily controlled.

DETAILED DESCRIPTION OF THE INVENTION

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Details with respect to the composition and function of a wide variety of different imaging elements are provided in U.S. Pat. No. 5,340,676 and references described therein. The present invention can be effectively employed in conjunction with any of the imaging elements described in the '676 patent.

Photographic elements represent an important class of imaging elements within the scope of the present invention. In such elements, the electrically-conductive layer can be applied as a subbing layer, as an intermediate layer, or as the outermost layer on the sensitized emulsion side of the support, on the side of the support opposite the emulsion, or on both sides of the support. When the electrically-conductive layer is on the side of the support opposite to the emulsion layer, it can be overcoated with an anti-curl layer. The support may comprise any commonly used photographic support material such as polyester, cellulose acetate, or resin-coated paper. The electrically-conductive layer is applied from a coating formulation comprising essentially electronically-conductive fine particles and gelatin-coated, water-insoluble polymer particles. The conductive particle can be, for example, a doped-metal oxide, a metal oxide containing oxygen deficiencies, a metal antimonate, or a conductive nitride, carbide, or boride. Representative examples of conductive fine particles include conductive $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TAB_2$, $CrB_2$, MoB, WB, $LAB_6$, ZrN, TiN, TiC, and WC. The conductive fine particles typically have an average particle size less than about 0.3 μm and a powder resistivity of $10^5$ Ω· cm or less.

The gelatin-coated, water-insoluble polymer particles utilized in this invention preferably have an average diameter of about 10 nm to about 1000 nm. More preferably, the particles have an average diameter of 20 to 500 nm. The gelatin can be any of the types of gelatin known in the photographic art. These include, for example, alkali-treated gelatin (cattle bone or hide gelatin), acid-treated gelatin (pigskin or bone gelatin), and gelatin derivatives such as partially phthalated gelatin, acetylated gelatin, and the like.

The polymer particle coated with gelatin is a water-dispersible, nonionic or anionic polymer or interpolymer prepared by emulsion polymerization of ethylenically unsaturated monomers or by post emulsification of preformed polymers. In the latter case, the preformed polymers may be first dissolved in an organic solvent and then the polymer solution emulsified in an aqueous media in the presence of an appropriate emulsifier. Representative polymer particles include those comprising polymers and interpolymers of styrene, styrene derivatives, alkyl acrylates or alkyl methacrylates and their derivatives, olefins, vinylidene chloride, acrylonitrile, acrylamide and methacrylamide and their derivatives, vinyl esters, vinyl ethers and urethanes. In addition, crosslinking monomers such as 1,4-butyleneglycol methacrylate, trimethylolpropane. triacrylate, allyl methacrylate, diallyl phthalate, divinyl benzene, and the like may be used in order to give a crosslinked polymer particle. The glass transition temperature ($T_g$) of the polymer particle may vary widely, but, most preferably the Tg should be at least 20° C. to provide the greatest reduction in the volume % of conductive particle required in conductive coating compositions. The polymer particle may be a core-shell particle as described, for example, in U.S. Pat. No. 4,497,917. The gelatin-coated polymer particle can be prepared either by having at least a part of its emulsion polymerization conducted in the presence of gelatin and/or by adding gelatin and a crosslinking agent after completion of the emulsion polymerization or post emulsification in order to link the polymer particle and gelatin through the crosslinking agent.

Gelatin-coated polymer particles have been described in the photographic art. U.S. Pat. No. 2,956,884 describes the preparation of polymer latices in the presence of gelatin and the application of such materials in photographic emulsion and subbing layers. U.S. Pat. No. 5,330,885 describes a silver halide photographic imaging element containing a photographic emulsion layer, emulsion overcoat, backing layer, and backing layer overcoat in which at least one layer contains a polymer latex made in the presence of gelatin. U.S. Pat. No. 5,374,498 describes a hydrophilic colloid layer provided on the photographic emulsion layer side of the support that contains a latex comprising polymer particles stabilized with gelatin. U.S. Pat. Nos. 5,066,572 and 5,248,558 describe case-hardened gelatin-grafted soft polymer particles that are incorporated into photographic emulsion layers to reduce pressure sensitivity. Although the above-mentioned prior art references describe layers containing gelatin-coated or gelatin-containing polymer particles they do not disclose the use of these particles in conductive layers or suggest the benefits with respect to solution stability or reduction in volume % conductive fine particles taught in the present invention.

The gelatin/polymer weight ratio of the gelatin-coated polymer particle is preferably 5/95 to 40/60. At gelatin/polymer ratios less than 5/95 the polymer particle is not sufficiently coated with gelatin to provide the improvements in solution stability and wet abrasion properties and for ratios greater than 40/60 there is insufficient polymer particle to provide the desired reduction in volume % conductive particles required in the conductive coating.

The conductive layer preferably comprises 50 volume % or less of the conductive fine particles, more preferably the conductive layer comprises 35 volume % or less of the conductive fine particles. The amount of the conductive particle contained in the coating is defined in terms of volume % rather than weight % since the densities of the conductive particles and polymer binders may differ widely. The binder for the conductive particles comprises the gelatin-coated polymer particles and, optionally, up to 20 weight % (based on the total dry weight of the gelatin-coated polymer particles) additional gelatin. The conductive layer can additionally contain wetting aids, matte particles, biocides, dispersing aids, hardeners, and antihalation dyes. The conductive layer is applied from an aqueous coating formulation to give dry coating weights which are preferably in the range of about 100 to about 1500 mg/m$^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers); timing layers, opaque reflecting layers; opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The invention is further illustrated by the following examples of its practice.

PREPARATION OF GELATIN-COATED POLYMER PARTICLES

A stirred reactor containing 1069 g of deionized water, 60.0 g of lime-processed bone gelatin, and 6.0 g of 30% aqueous Triton 770 surfactant (Rohm & Haas Co.) was heated to 80° C. and purged with $N_2$ for 1 hour. After addition of 0.45 g of potassium persulfate, an emulsion containing 150.0 g of deionized water, 176.4 g of ethyl acrylate, 3.6 g of sodium styrene sulfonate, 27.0 g of 10% aqueous Olin 10G surfactant, 6.0 g of 30% aqueous Triton 770 surfactant, 0.3 g of sodium bicarbonate and 0.45 g of potassium persulfate was slowly added over a period of 1 hour. The reaction was allowed to continue for an additional 2 hours. After the reaction was completed the gel-coated latex was purged with a $N_2$ sweep for 30 minutes to remove any residual unreacted momoner. An additional 36.0 g of 10% aqueous Olin 10G surfactant was added and the gel-coated latex (designated particle P-1) was cooled to room temperature, filtered, and refrigerated. The total percent solids of the gel-coated latex was 14.5 weight % and the particle size using a light scattering technique was measured at 180 nm for the gel-coated particle and 62 nm for the particle in which the gelatin was removed by enzymolysis. The other gel-coated polymer particles used in the following examples were prepared in an analogous manner and their compositions are described in Table 1.

TABLE 1

| Particle | Polymer Composition | Gel/ Polymer ratio | Tg, °C. | Particle Size, nm (with gel) | Particle Size, nm (gel removed) |
|---|---|---|---|---|---|
| P-1 | ethyl acrylate/sodium styrene sulfonate 98/2 | 25/75 | −20 | 320 | 62 |
| P-2 | ethyl methacrylate/ sodium styrene sulfonate 99/1 | 25/75 | 65 | 137 | 60 |
| P-3 | methyl methacrylate/ sodium styrene sulfonate 98/2 | 25/75 | 125 | 164 | 60 |
| C-1 | ethyl acrylate/sodium acrylamido-2-propane sulfonate/2-aceto-acetoxy ethyl methacrylate 93.6/4.4/2 | 0/100 | −20 | — | 76* |
| C-2 | ethyl methylacrylate/ sodium acrylamido-2-propane sulfonate/2-acetoacetoxy ethyl methacrylate 93.6/4.4/2 | 0/100 | 65 | — | 78* |
| C-3 | methyl methacrylate/ methacrylic acid 97/3 | 0/100 | 125 | — | 48* |

*-these comparative particles were not made in the presence of gelatin.

EXAMPLES 1–3 AND COMPARATIVE SAMPLES A–C

Antistat coatings comprising conductive fine particles and polymer binder were coated onto 4 mil thick polyethylene terephthalate film support that had been subbed with a terpolymer latex of acrylonitrile, vinylidene chloride, and acrylic acid. The aqueous coating formulations comprising about 4 weight % total solids were dried at 120° C. to give dried coating weights of 1000 mg/m$^2$. The coating formulations contained; 2.4 weight % of conductive tin oxide particles (doped with 6% antimony) with an average particle size of about 50 nm, 1.6 weight % of a polymer binder, 3 weight % of 2,3-dihydroxy-1,4-dioxane gelatin hardener based on the total weight of gelatin in the coating composition, and 0.01 weight % of Olin 10G surfactant.

The surface resistivity of the coatings was measured at 20% relative humidity using a 2-point probe. The coating compositions and resistivities for the coatings are tabulated in Table 2. For purposes of comparison, results are also reported for Comparative Samples A to C in which either gelatin alone was used as the binder or the polymer particle and gel mixtures described in U.S. Pat. No. 5,340,676 were used as the binder.

Coatings of the invention provide improved conductivity at low volume % of the conductive particle compared with those comprising only gelatin as the binder and the resistivities are comparable to the polymer particle and gel mixtures taught in U.S. Pat. No. 5,340,676.

TABLE 2

| Coating No. | Binder | Volume % $SnO_2$ | Surface Resistivity (Ω/□) |
|---|---|---|---|
| Example 1 | P-1 | 20 | $5.0 \times 10^9$ |
| Example 2 | P-2 | 20 | $4.0 \times 10^8$ |
| Example 3 | P-3 | 20 | $1.0 \times 10^9$ |
| Sample A | gelatin | 20 | $4.0 \times 10^{12}$ |
| Sample B | 25/75 gelatin/C-1 | 20 | $4.0 \times 10^9$ |
| Sample C | 25/75 gelatin/C-2 | 20 | $4.0 \times 10^8$ |

Dry adhesion of the conductive layers to the support was determined by scribing small hatch marks in the coating with a razor blade, placing a piece of high tack tape over the scribed area and then quickly pulling the tape from the surface. The amount of the scribed area removed is a measure of the dry adhesion. Wet adhesion for the coatings was tested by placing the test samples in deionized water at 35° C. for 1 minute. While still wet, a one millimeter wide line was scribed in the coating and a finger was rubbed vigorously across the scribe line. The percent of the rubbed area that was removed was used as a measure of wet adhesion. The adhesion results for Examples 1 and 2 that comprise gel-coated polymer particles and Samples B and C that comprise mixtures of gelatin with analogous non-gel-coated polymer particles are shown in Table 3. As can be seen, the wet adhesion for coatings of the invention is superior to the comparative samples featuring the binders taught in the '676 patent.

TABLE 3

| Coating No. | Wet Adhesion (% removed) | Dry Adhesion (% removed) |
|---|---|---|
| Example 1 | 10 | 0 |
| Example 2 | 10 | 0 |
| Sample B | 50 | 0 |
| Sample C | 100 | 0 |

EXAMPLES 4–9 AND COMPARATIVE SAMPLES D AND E

The following examples demonstrate the excellent solution stability for coating compositions of the invention. The following aqueous formulations were prepared and maintained at 45° C. to evaluate their stability against flocculation at various times. The results are shown in Table 4.

Solution 1: 2.00 weight % conductive tin oxide particles, 1.33 weight % P-1, 0.01 weight % 2,3-dihydroxy-1,4-dioxane, and 0.01 weight % Olin 10G surfactant and a balance of deionized water.

Solution 2: 1.33 weight % conductive tin oxide particles, 2.00 weight % P-1, 0.015 weight % 2,3-dihydroxy-1,4-dioxane, and 0.01 weight % Olin 10G surfactant and a balance of deionized water.

Solution 3: 2.00 weight % conductive tin oxide particles, 1.33 weight % P-2, 0.01 weight % 2,3-dihydroxy-1,4-dioxane, and 0.01 weight % Olin 10G surfactant and a balance of deionized water.

Solution 4: 1.33 weight % conductive tin oxide particles, 2.00 weight % P-2, 0.015 weight % 2,3-dihydroxy-1,4-dioxane, and 0.01 weight % Olin 10G surfactant and a balance of deionized water.

Solution 5: 2.00 weight % conductive tin oxide particles, 1.33 weight % P-3, 0.01 weight % 2,3-dihydroxy-1,4-dioxane, and 0.01 weight % Olin 10G surfactant and a balance of deionized water.

Solution 6: 1.33 weight % conductive tin oxide particles, 2.00 weight % P-3, 0.015 weight % 2,3-dihydroxy-1,4-dioxane, and 0.01 weight % Olin 10G surfactant and a balance of deionized water.

Solution 7: 2.00 weight % conductive tin oxide particles, 1.00 weight % C-3, 0.33 weight % gelatin, 0.01 weight % 2,3-dihydroxy-1,4-dioxane, and 0.01 weight % Olin 10G surfactant and a balance of deionized water.

Solution 8: 1.33 weight % conductive tin oxide particles, 1.50 weight % C-3, 0.50 weight % gelatin, 0.015 weight % 2,3-dihydroxy-1,4-dioxane, and 0.01 weight % Olin 10G surfactant and a balance of deionized water.

As shown in Table 4, the coating compositions of the invention have excellent stability even after aging for 48 hours. Coating compositions of comparative samples D and E comprising a binder that is a mixture of a latex particle and gelatin, rather than a gelatin-coated latex particle of the invention, exhibited a large amount of flocculation after 24 hours aging.

TABLE 4

| Sample | Solution # | Stability, fresh | Stability, 24 hrs | Stability, 48 hrs |
|---|---|---|---|---|
| Example 4 | 1 | Excellent | Excellent | Excellent |
| Example 5 | 2 | Excellent | Excellent | Excellent |
| Example 6 | 3 | Excellent | Excellent | Excellent |
| Example 7 | 4 | Excellent | Excellent | Excellent |
| Example 8 | 5 | Excellent | Excellent | Excellent |
| Example 9 | 6 | Excellent | Excellent | Excellent |
| Comparative Sample D | 7 | Excellent | Poor | Poor |
| Comparative Sample E | 8 | Excellent | Poor | Poor |

As shown by the above examples, use of gelatin-coated water-insoluble polymer particles as a binder for electronically-conductive fine particles in electrically-conductive layers of imaging elements provides many important advantages. In particular, excellent conductivity is achieved at low volume percentages of electronically-conductive fine particles, the electrically-conductive layer has excellent abrasion resistant properties, and the coating compositions from which the electrically-conductive layer is formed can be easily prepared in a stable form.

The invention has been described in detail, with particular reference to certain preferred embodiments thereof, but it should be understood that variations and modifications can be effected within the spirit and scope of the invention.

We claim:

1. An imaging element for use in an image-forming process; said imaging element comprising a support, an image-forming layer and an electrically-conductive layer; said electrically-conductive layer comprising electronically-conductive fine particles and gelatin-coated water-insoluble polymer particles having a gelatin/polymer weight ratio of from 5/95 to 40/60.

2. An imaging element as claimed in claim 1, wherein said electronically-conductive fine particles are composed of a doped-metal oxide, a metal oxide containing oxygen deficiencies, a metal antimonate, or a conductive nitride, carbide or boride.

3. An imaging element as claimed in claim 1, wherein said electronically-conductive fine particles are antimony-doped tin oxide particles.

4. An imaging element as claimed in claim 1, wherein said electronically-conductive fine particles have an average particle size of less than about 0.3 μm and a powder resistivity of $10^5$ Ω· cm or less.

5. An imaging element as claimed in claim 1, wherein said gelatin-coated water-insoluble polymer particles have an average diameter of from about 10 nm to about 1000 nm.

6. An imaging element as claimed in claim 1, wherein said gelatin-coated water-insoluble polymer particles have an average diameter of from 20 nm to 500 nm.

7. An imaging element as claimed in claim 1, wherein said gelatin-coated water-insoluble polymer particles have a glass transition temperature of at least 20° C.

8. An imaging element as claimed in claim 1, wherein said water-insoluble polymer particles are selected from the group consisting of polymers of styrene, derivatives of styrene, alkyl acrylates, derivatives of alkyl acrylates, alkyl methacrylates, derivatives of alkyl methacrylates, olefins, vinylidene chloride, acrylonitrile, acrylamide, derivatives of acrylamide, methacrylamide, derivatives of methacrylamide, vinyl esters, vinyl ethers and urethanes.

9. An imaging element as claimed in claim 1, wherein said water-insoluble polymer particles are particles of a copolymer of ethyl acrylate and sodium styrene sulfonate.

10. An imaging element as claimed in claim 1, wherein said water-insoluble polymer particles are particles of a copolymer of ethyl methacryate and sodium styrene sulfonate.

11. An imaging element as claimed in claim 1, wherein said water-insoluble polymer particles are particles of a copolymer of methyl methacrylate and sodium styrene sulfonate.

12. An imaging element as claimed in claim 1, wherein said electrically-conductive layer comprises 50 volume % or less of said electronically-conductive fine particles.

13. An imaging element as claimed in claim 1, wherein said electrically-conductive layer comprises 35 volume % or less of said electronically-conductive fine particles.

14. An imaging element as claimed in claim 1, wherein said electrically-conductive layer comprises up to 20 weight percent of additional gelatin based on the total dry weight of said gelatin-coated water-insoluble polymer particles.

15. An imaging element as claimed in claim 1, wherein the dry coating weight of said electrically-conductive layer is in the range of from about 100 to about 1500 mg/m$^2$.

16. An imaging element as claimed in claim 1, wherein said support is a polyethylene terephthalate film.

17. A photographic film comprising:

(1) a support;

(2) an electrically-conductive layer which serves as an antistatic layer overlying said support; and (3) a silver halide emulsion layer overlying said electrically-conductive layer; said electrically-conductive layer comprising electronically-conductive fine particles having a gelatin/polymer weight ratio of from 5/95 to 40/60 and gelatin-coated water-insoluble polymer particles.

18. A photographic film comprising:

(1) a support;

(2) a silver halide emulsion layer on one side of said support;

(3) an electrically-conductive layer which serves as an antistatic layer on the opposite side of said support; and (4) an anti-curl layer overlying said electrically-conductive layer; said electrically-conductive layer comprising electronically-conductive fine particles having a gelatin/polymer weight ratio of from 5/95 to 40/60 and gelatin-coated water-insoluble polymer particles.

19. A photographic film comprising a cellulose ester or polyester support, an image-forming layer comprising a silver halide emulsion, and an electrically-conductive layer which serves as an antistatic layer; said electrically-conductive layer comprising electronically-conductive fine particles having an average particle size of less than about 0.3 μm and a powder resistivity of $10^5$ Ω· cm or less and gelatin-coated water-insoluble polymer particles having an average diameter of from 20 nm to 500 nm and a gelatin/polymer weight ratio of from 5/95 to 40/60.

* * * * *